US010105951B2

(12) United States Patent
Kondo et al.

(10) Patent No.: US 10,105,951 B2
(45) Date of Patent: Oct. 23, 2018

(54) LIQUID DISCHARGE APPARATUS, HEAD DRIVE CONTROL DEVICE, RECORDING MEDIUM, AND ACTUATOR DRIVE CONTROL DEVICE

(71) Applicants: Naoya Kondo, Kanagawa (JP); Takakazu Kihira, Ibaraki (JP); Masahiro Itoh, Tokyo (JP)

(72) Inventors: Naoya Kondo, Kanagawa (JP); Takakazu Kihira, Ibaraki (JP); Masahiro Itoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/422,432

(22) Filed: Feb. 1, 2017

(65) Prior Publication Data

US 2017/0225461 A1 Aug. 10, 2017

(30) Foreign Application Priority Data

Feb. 5, 2016 (JP) ..... 2016-021252
Nov. 24, 2016 (JP) ..... 2016-228198

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04581; B41J 2/04588; B41J 2/14233; B41J 2/161
USPC ..... 347/5, 9, 10, 14, 68
See application file for complete search history.

(56) References Cited

U.S. PATENT DOCUMENTS

| | | | |
|---|---|---|---|
| 2011/0175967 | A1 | 7/2011 | Machida et al. |
| 2011/0205307 | A1 | 8/2011 | Ueda et al. |
| 2012/0038712 | A1 | 2/2012 | Akiyama et al. |
| 2012/0236067 | A1 | 9/2012 | Tajima et al. |
| 2012/0276303 | A1 | 11/2012 | Watanabe et al. |
| 2012/0314007 | A1 | 12/2012 | Shimofuku et al. |
| 2013/0002767 | A1 | 1/2013 | Mizukami et al. |
| 2014/0049582 | A1 | 2/2014 | Machida et al. |
| 2014/0210913 | A1 | 7/2014 | Shimofuku et al. |
| 2014/0268481 | A1 | 9/2014 | Akiyama et al. |
| 2014/0340854 | A1 | 11/2014 | Akiyama et al. |

(Continued)

FOREIGN PATENT DOCUMENTS

| | | |
|---|---|---|
| JP | 2001-138498 | 5/2001 |
| JP | 2005-349647 | 12/2005 |

(Continued)

*Primary Examiner* — Jannelle M Lebron
(74) *Attorney, Agent, or Firm* — Duft Bornsen & Fettig LLP

(57) ABSTRACT

A liquid discharge apparatus includes a liquid discharge head and a head drive controller. The liquid discharge head includes an actuator including an electromechanical transducer element. The head drive controller controls the liquid discharge head. The head drive controller includes a drive waveform generator and a voltage updater. The drive waveform generator generates a drive waveform to be applied to the electromechanical transducer element. The voltage updater updates a voltage value of the drive waveform to a larger value with an elapse of time. The voltage updater sets a time interval of update of the voltage value to be longer as a number of times of the update is greater.

15 Claims, 15 Drawing Sheets

(56) References Cited

U.S. PATENT DOCUMENTS

| | | | |
|---|---|---|---|
| 2015/0022592 | A1 | 1/2015 | Aoyama et al. |
| 2015/0070444 | A1 | 3/2015 | Ishimori et al. |
| 2015/0145924 | A1 | 5/2015 | Shimofuku et al. |
| 2015/0263263 | A1 | 9/2015 | Akiyama et al. |
| 2016/0049579 | A1 | 2/2016 | Shimofuku et al. |
| 2016/0221033 | A1 | 8/2016 | Akiyama et al. |
| 2016/0221336 | A1* | 8/2016 | Karasawa ..... B41J 2/04588 |
| 2016/0339694 | A1 | 11/2016 | Kihira et al. |

FOREIGN PATENT DOCUMENTS

| | | |
|---|---|---|
| JP | 2009-066805 | 4/2009 |
| JP | 2009-066948 | 4/2009 |
| JP | 2013-075458 | 4/2013 |
| JP | 2016-215446 | 12/2016 |

* cited by examiner

FIG. 18

| | b | ENVIRONMENTAL TEMPERATURE | RATE OF CHANGE OF DISCHARGE SPEED | VARIATION OF DISCHARGE SPEED |
|---|---|---|---|---|
| EXAMPLE 1 | 4500 | 25°C | GOOD | VERY GOOD |
| EXAMPLE 2 | 4500 | 10°C | GOOD | VERY GOOD |
| EXAMPLE 3 | 4500 | 40°C | GOOD | VERY GOOD |
| EXAMPLE 4 | 5000 | 25°C | GOOD | GOOD |
| COMPARATIVE EXAMPLE 1 | UPDATE INTERVAL: CONSTANT | 25°C | POOR | POOR |
| COMPARATIVE EXAMPLE 2 | UPDATE INTERVAL: SHORTENED | 25°C | POOR | POOR |

LIQUID DISCHARGE APPARATUS, HEAD DRIVE CONTROL DEVICE, RECORDING MEDIUM, AND ACTUATOR DRIVE CONTROL DEVICE

CROSS-REFERENCE TO RELATED APPLICATIONS

This patent application is based on and claims priority pursuant to 35 U.S.C. § 119(a) to Japanese Patent Application Nos. 2016-021252 filed on Feb. 5, 2016 and 2016-228198 filed on Nov. 24, 2016 in the Japan Patent Office, the entire disclosure of each of which is hereby incorporated by reference herein.

BACKGROUND

Technical Field

Embodiments of the present disclosure relate to a liquid discharge apparatus, a head drive control device, a non-transitory recording medium storing a program, and an actuator drive control device.

Related Art

When an electromechanical transducer element is used as a pressure generator of a liquid discharge head, for example, a phenomenon occurs, in which the displacement amount of the electromechanical transducer element varies due to repetitive driving, and discharge characteristics are not stabilized.

Therefore, conventionally, a reference voltage value of a drive waveform (drive signal) may be changed to reduce the variation of the displacement amount.

SUMMARY

In an aspect of the present disclosure, there is provided a liquid discharge apparatus that includes a liquid discharge head and a head drive controller. The liquid discharge head includes an actuator including an electromechanical transducer element. The head drive controller controls the liquid discharge head. The head drive controller includes a drive waveform generator and a voltage updater. The drive waveform generator generates a drive waveform to be applied to the electromechanical transducer element. The voltage updater updates a voltage value of the drive waveform to a larger value with an elapse of time. The voltage updater sets a time interval of update of the voltage value to be longer as a number of times of the update is greater.

In another aspect of the present disclosure, there is provided a non-transitory storage medium storing a program for causing a computer to perform processing. The processing includes controlling, updating, and setting. The controlling is to control generation and output of a drive waveform to be applied to the electromechanical transducer element of the actuator of the liquid discharge head. The updating is to update a voltage value of the drive waveform to a larger value with an elapse of time. The setting is to set a time interval of the updating of the voltage value to be longer as a number of times of the updating is greater.

In still another aspect of the present disclosure, there is provided a head drive control device that includes a drive waveform generator and a voltage updater. The drive waveform generator generates a drive waveform to be applied to an electromechanical transducer element of an actuator of a liquid discharge head, to drive and control the liquid discharge head. The voltage updater updates a voltage value of the drive waveform to a larger value with an elapse of time. The voltage updater sets a time interval of update of the voltage value to be longer as a number of times of the update is greater.

In still yet another aspect of the present disclosure, there is provided an actuator drive control device that includes a drive waveform generator and a voltage updater. The drive waveform generator generates a drive waveform to be applied to an electromechanical transducer element of an actuator, to drive and control the actuator. The voltage updater updates a voltage value of the drive waveform to a larger value with an elapse of time. The voltage updater sets a time interval of update of the voltage value to be longer as a number of times of the update is greater.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 18 is an illustration of configurations and evaluation results of the examples and the comparative examples according to an embodiment of the present disclosure.

Figure 1:
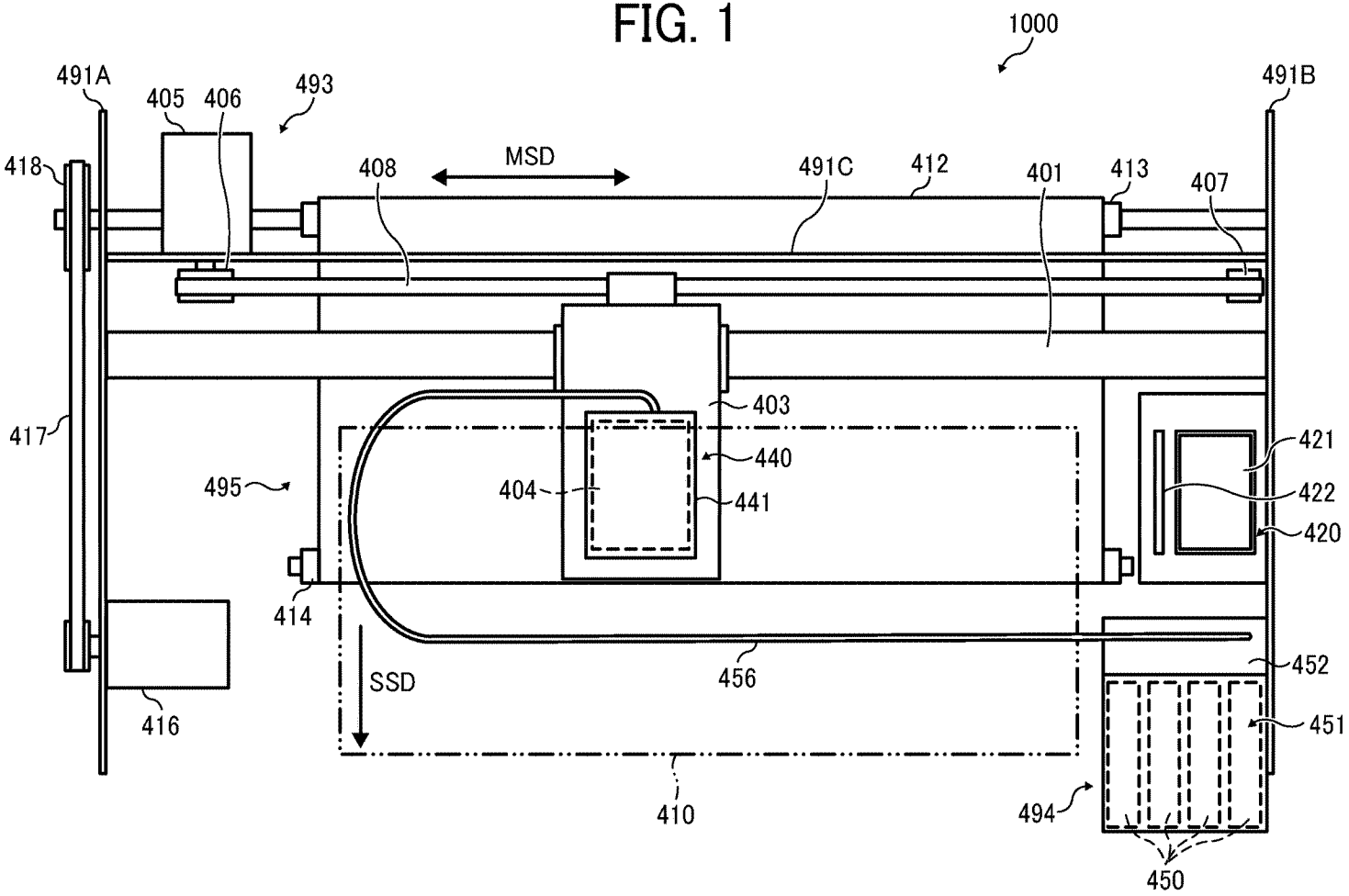
FIG. 1 is a plan view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
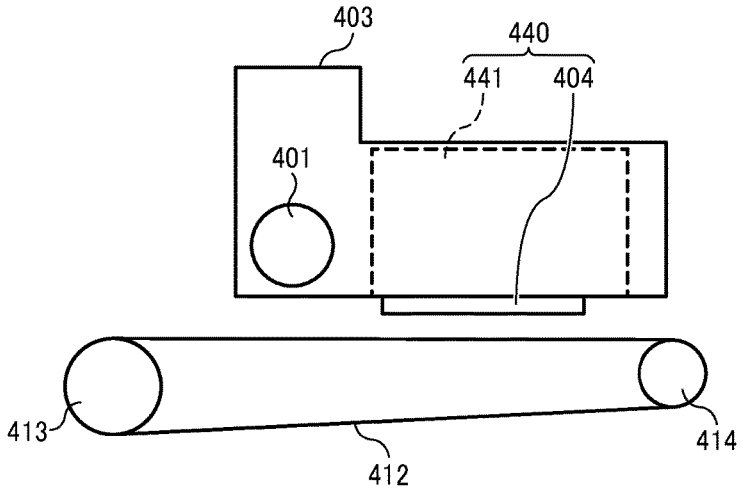
FIG. 2 is a side view of a portion of the liquid discharge apparatus of FIG. 1.

Referring now to the drawings, wherein like reference numerals designate identical or corresponding parts throughout the several views, embodiments of the present disclosure are described below. First, a liquid discharge apparatus according to an embodiment of this disclosure is described with reference to FIGS. 1 and 2. FIG. 1 is a plan view of a portion of the liquid discharge apparatus according to an embodiment of the present disclosure. FIG. 2 is a side view of a portion of the liquid discharge apparatus of FIG. 1.

A liquid discharge apparatus 1000 according to the present embodiment is a serial-type apparatus in which a main scan moving unit 493 reciprocally moves a carriage 403 in a main scanning direction indicated by arrow MSD in FIG. 1. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 is mounted with a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 41, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 100 includes a conveyance unit 495 to convey a sheet material 410. The conveyance unit 495 includes a conveyance belt 412 as a conveyor and a sub-scanning motor 416 to drive the conveyance belt 412.

The conveyance belt 412 electrostatically attracts the sheet material 410 and conveys the sheet material 410 at a position facing the liquid discharge head 404. The conveyance belt 412 is an endless belt and is stretched between a conveyance roller 413 and a tension roller 414. The sheet material 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, a sheet material 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet material 410 stopped, thus forming an image on the sheet material 410.

Figure 3:
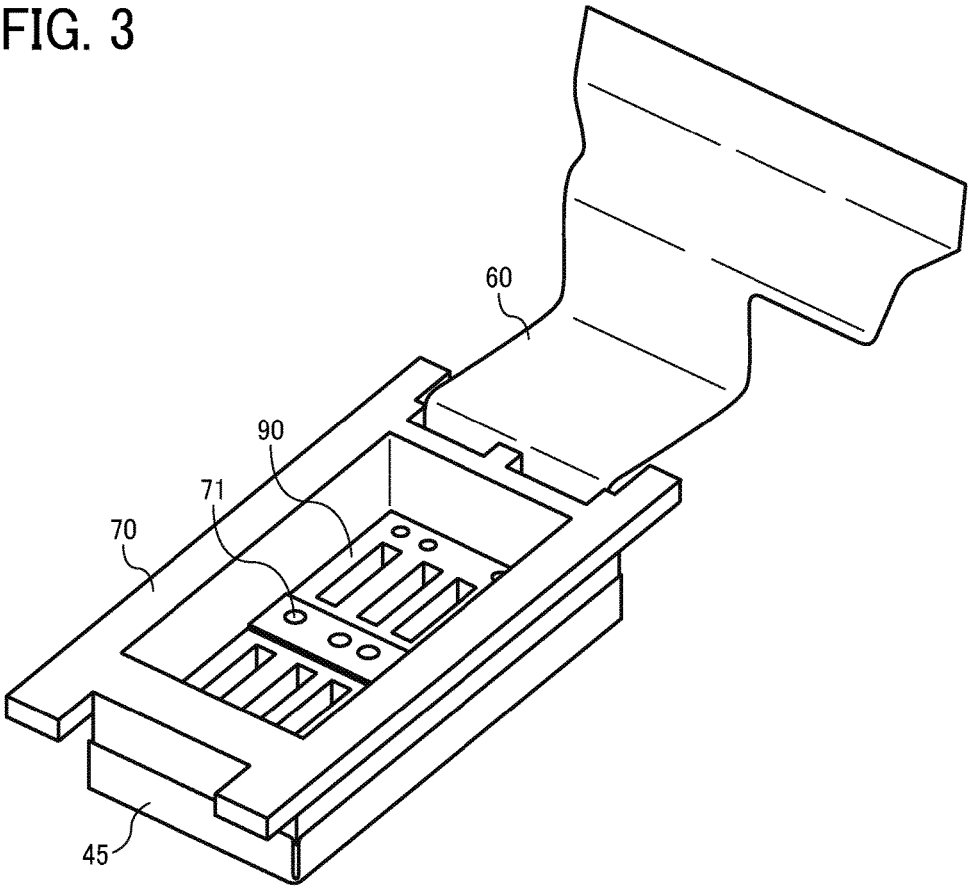
FIG. 3 is an exploded perspective view of a liquid discharge head according to an embodiment of the present disclosure.
Figure 4:
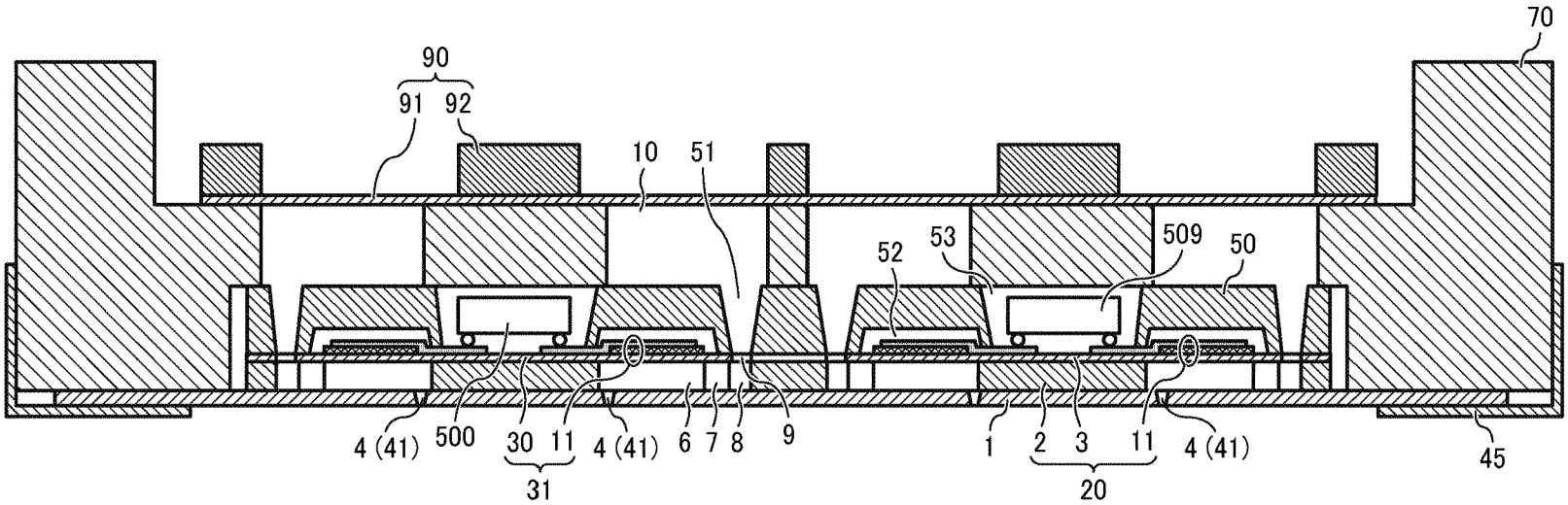
FIG. 4 is a cross-sectional view of the liquid discharge head of FIG. 3 cut along a direction perpendicular to a nozzle array direction.
Figure 5:
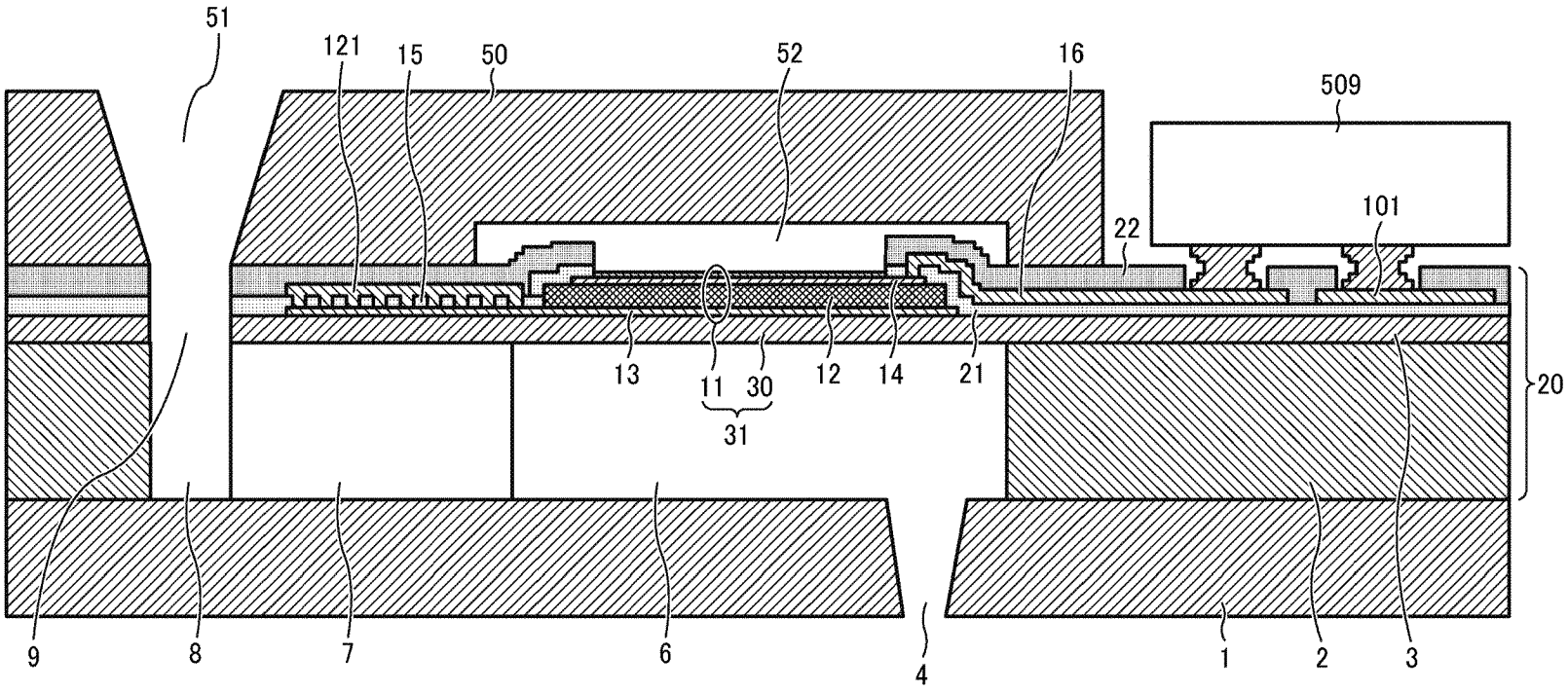
FIG. 5 is an enlarged cross-sectional view of a portion of the liquid discharge head of FIG. 3.
Figure 6:
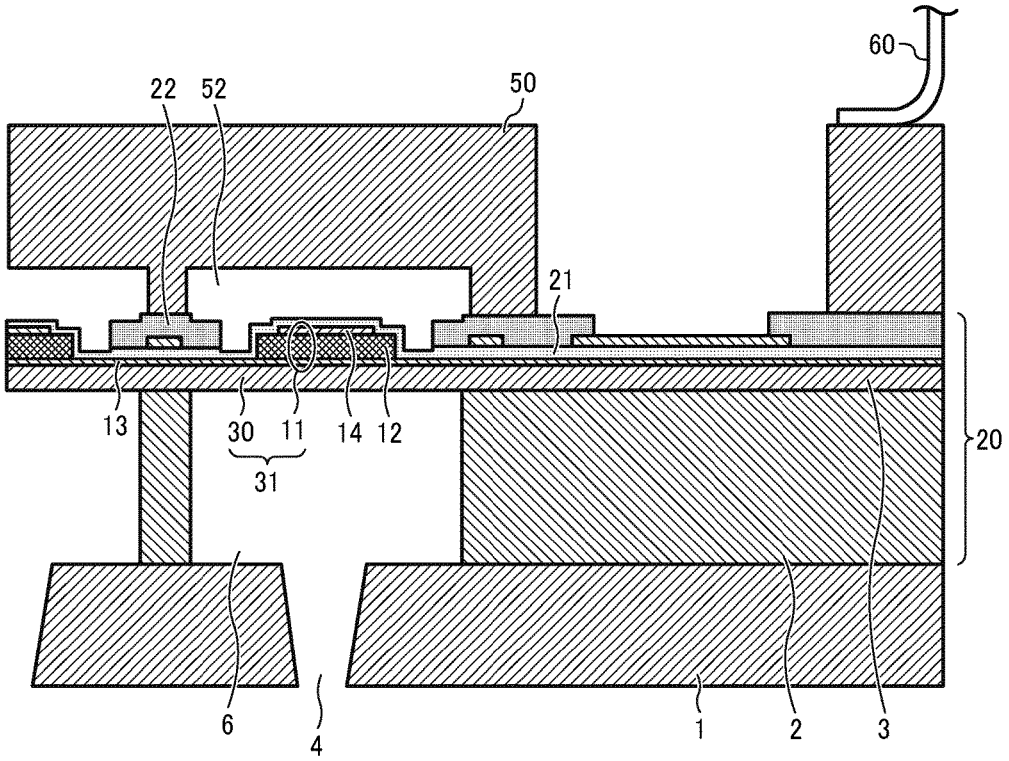
FIG. 6 is a cross-sectional view of a portion of the liquid discharge head of FIG. 3 cut along the nozzle array direction.

A liquid discharge head according to an embodiment of the present disclosure is described with reference to FIGS. 3 to 6. FIG. 3 is an exploded perspective view of the liquid discharge head according to an embodiment of the present disclosure. FIG. 4 is a cross-sectional view of the liquid discharge head of FIG. 3 cut along a direction perpendicular to a nozzle array direction in which nozzles are arrayed in row. FIG. 5 is an enlarged cross-sectional view of a portion of the liquid discharge head of FIG. 4. FIG. 6 is a cross-sectional view of a portion of the liquid discharge head of FIG. 3 cut along the nozzle array direction.

The liquid discharge head 404 includes a nozzle plate 1, a channel plate 2, a diaphragm plate 3 as a wall member, electromechanical transducer elements (hereinafter, piezoelectric elements) 11 constituting pressure generators, a holding substrate 50, a wiring member 60, and a frame substrate 70 also serving as a common-liquid-chamber substrate.

In the present embodiment, the channel plate 2, the diaphragm plate 3, and the piezoelectric elements 11 constitute an actuator substrate 20. Note that the actuator substrate 20 does not include the nozzle plate 1 or the holding substrate 50 that is bonded to the actuator substrate 20 after the actuator substrate 20 is formed as an independent component.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid introduction portions 8 communicated with the fluid restrictors 7.

The liquid introduction portions 8 are communicated with the common liquid chambers 10 in the frame substrate 70 via supply ports 9 of the diaphragm plate 3 and openings 51 as channels of the holding substrate 50.

The diaphragm plate 3 includes deformable vibration portions 30 forming part of walls of the individual liquid chambers 6. The piezoelectric element 11 as the electromechanical transducer element is disposed integrally with the vibration portion 30 of the diaphragm plate 3 on a face of the vibration portion 30 opposite the individual liquid chamber 6. The vibration portion 30 and the piezoelectric element 11 form a piezoelectric actuator 31.

In the piezoelectric element 11, a common electrode 13 as a lower electrode, a piezoelectric layer (piezoelectric body) 12, and an individual electrode 14 as an upper electrode are laminated in the recited order from the vibration portion 30 (the diaphragm plate 3). An insulation film 21 is disposed on the piezoelectric element 11.

Note that the common electrode 13 for the plurality of piezoelectric elements 11 is a single electrode layer straddling all of the piezoelectric elements 11 in the nozzle array direction indicated by arrow NAD. A common-electrode power-supply wiring pattern 121 is connected to a portion 15 not constituting the piezoelectric element 11.

The individual electrodes 14 for the piezoelectric elements 11 are connected to a driver integrated circuit (IC) 509 (referred to as "head driver" in the circuit configuration) as a drive circuit via individual wires 16. The individual wire 16 is covered with an insulation film 22.

The driver IC 509 is mounted on the actuator substrate 20 by, e.g., a flip-chip bonding method, to cover an area between rows of the piezoelectric elements 11.

The holding substrate 50 is disposed on the actuator substrate 20.

The holding substrate 50 that forms part of walls of the common liquid chambers 10 is also a channel forming substrate that forms part of a channel from the common liquid chambers 10 to the individual liquid chambers 6. The holding substrate 50 also has the openings 51 acting as channels passing through the common liquid chambers 10 and the individual liquid chambers 6 side.

The holding substrate 50 further has a function to hold the actuator substrate 20 and has openings 53 to accommodate driver ICs 509 and recesses 52 accommodating the piezoelectric elements 11.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71.

A damper unit 90 is bonded to the frame substrate 70. The damper unit 90 includes a damper 91 and damper plates 92. The damper 91 is deformable and forms part of wall faces of the common liquid chambers 10. The damper plates 92 reinforce the damper 91.

The frame substrate 70 is bonded to an outer peripheral portion of the nozzle plate 1, to accommodate the actuator substrate 20 and the holding substrate 50, thus forming a frame of the liquid discharge heads 404.

A cover 45 is disposed to cover a peripheral area of the nozzle plate 1 and a part of the outer circumferential face of the frame substrate 70.

In the liquid discharge heads 404, the driver IC 509 applies drive voltage between the common electrode 13 and the individual electrodes 14 of the piezoelectric actuator 31 of the piezoelectric element 11 to flexurally deform the piezoelectric element 11. Thus, the vibration portion 30 deforms towards the individual liquid chambers 6 and presses the liquid in the individual liquid chambers 6 so that the liquid is discharged through the nozzles 4.

Figure 7:
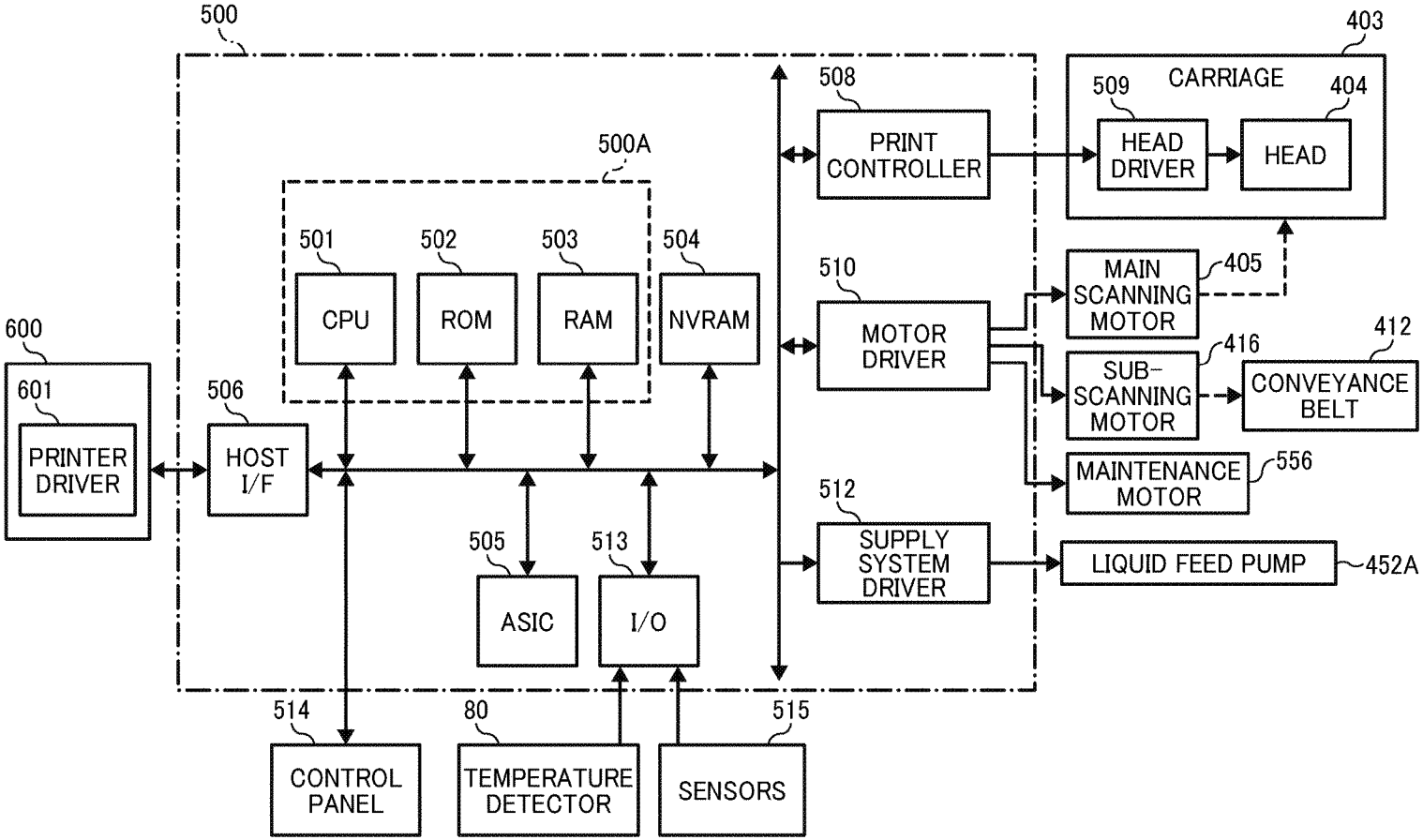
FIG. 7 is a block diagram of a controller of the liquid discharge apparatus of FIG. 1.

Next, an outline of the controller of the liquid discharge apparatus is described with reference to FIG. 7. FIG. 7 is a block diagram of the controller of the liquid discharge apparatus according to an embodiment of the present disclosure.

In FIG. 7, the controller 500 includes a main controller 500A that includes a central processing unit (CPU) 501, a read-only memory (ROM) 502, and a random access memory (RAM) 503. The CPU 501 administrates the control of the entire liquid discharge apparatus 100. The ROM 502 stores fixed data, such as various programs including programs executed by the CPU 501, and the RAM 503 temporarily stores image data and other data.

The controller 500 includes a rewritable nonvolatile random access memory (NVRAM) 504 to retain data during the apparatus is powered off. The controller 500 includes an application specific integrated circuit (ASIC) 505 to perform image processing, such as various signal processing and sorting, on image data and process input and output signals to control the entire image forming apparatus.

The controller 500 also includes a print controller 508 and a driver integrated circuit (hereinafter, head driver) 509. The print controller 508 includes a data transmitter, a drive signal generator, and a bias voltage output unit to drive and control the liquid discharge head 404. The head driver 509 drives the liquid discharge head 404.

The controller 500 further includes a motor driver 510 to drive a main scanning motor 405, a sub-scanning motor 416, and a maintenance motor 556. The main scanning motor 405 moves the carriage 403 for scanning, and the sub-scanning motor 416 circulates the conveyance belt 412. The maintenance motor 556 moves the cap 421 and the wiper 422 of the maintenance unit 420 and drives a suction device connected to the cap 421.

The controller 500 includes a supply-system driver 512 to drive a liquid feed pump 452A of a liquid feed unit 452.

The controller 500 includes an input-output (I/O) unit 513. The I/O unit 513 performs various sensor data and acquires detection signals from the temperature detector 80 of the liquid discharge head 404 and data from sensors 515 mounted in the liquid discharge apparatus 100. The I/O unit 513 also extracts data for controlling printing operation, and uses extracted data to control the print controller 508 and the motor driver 510.

The sensors 515 include, for example, an optical sensor to detect a position of a sheet material 410 and an interlock switch to detect the opening and closing of a cover.

The controller 500 is connected to a control panel 514 to input and display information necessary to the liquid discharge apparatus 100.

Here, the controller 500 includes an interface (I/F) 506 to send and receive data and signals to and from a host 600, such as an information processing apparatus (e.g., a personal computer) or an image reader. The controller 500 receives such data and signals from the host 600 with the I/F 506 via a cable or network.

The CPU 501 of the controller 500 reads and analyzes print data stored in a reception buffer of the I/F 506, performs desired image processing, data sorting, or other processing with the ASIC 505, and transfers image data from the print controller 508 to the head driver 509.

The print controller 508 transfers the image data as serial data and outputs to the head driver 509, for example, transfer clock signals, latch signals, and selection signals required for the transfer of image data and determination of the transfer.

The print controller 508 includes a drive-waveform storing unit and a drive waveform generator (a unit to generate drive waveform). The drive-waveform storing unit stores pattern data of drive waveforms. The drive waveform generator includes, e.g., a digital/analog (D/A) converter (to perform digital/analog conversion on pattern data of drive waveform), a voltage amplifier, and a current amplifier. The print controller 508 generates a drive waveform containing one or more drive pulses from the drive signal generator and outputs the drive waveform to the head driver 509.

In accordance with serially-inputted image data corresponding to one line recorded by the liquid discharge head 404, the head driver 509 selects drive pulses of a drive waveform transmitted from the print controller 508 and applies the selected drive pulses to the piezoelectric element 11 serving as the pressure generator to drive the liquid discharge head 404. Thus, the liquid discharge heads 404 are driven.

At this time, the head driver 509 selects a part (a part of waveform elements forming a drive pulse) or all of one or more drive pulses constituting a drive waveform. Thus, the liquid discharge heads 404 can selectively discharge different sizes of droplets, e.g., large droplets, medium droplets, and small droplets to form different sizes of dots.

Figure 8:
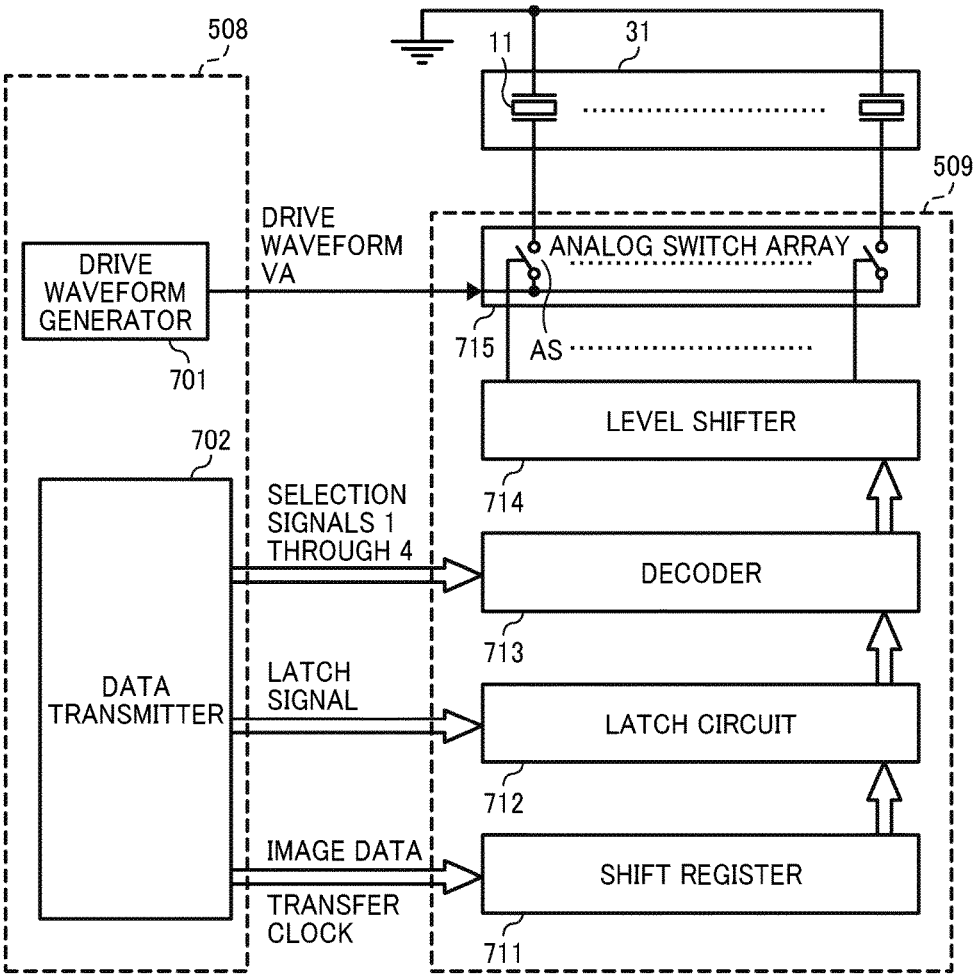
FIG. 8 is a block diagram of a portion relating to head drive control of the controller according to an embodiment of the present disclosure.

Next, a portion relating to head drive control according to an embodiment is described with reference to a block diagram illustrated in FIG. 8.

The print controller 508 includes a drive waveform generator 701 as the drive waveform generator to generate and output a drive waveform PV. The print controller 508 also includes a data transmitter 702 to output image data of two bits (gradation signals 0 and 1) corresponding to a print image, clock signals, latch signals, and selection signals (droplet control signals) for selecting drive pulses contained in a common drive waveform.

The drive waveform generator 701 generates and outputs at least the drive waveform PV in which a plurality of drive pulses (drive signals) for discharging liquid in one printing period is arranged in time series (one drive period).

The selection signals instruct opening and closing of an analog switch AS for each droplet. The analog switch AS is a switching unit of the head driver 509. The selection signals transit the states to the level H (ON) for a drive pulse (or waveform element) to be selected and to the level L (OFF) for a driving pulse not to be selected in accordance with a printing period of the drive waveform PV.

The head driver 509 includes a shift register 711, a latch circuit 712, a decoder 713, a level shifter 714, and an analog switch array 715.

To the shift register 711, transfer clock (shift clock) and serial image data (gradation data: two bits/one channel (one nozzle)) are input from the data transmitter 702. The latch circuit 712 latches each resist value of the shift register 711 corresponding to latch signals.

The decoder 713 decodes the gradation data and the selection signals to output the result of decoding. The level shifter 714 performs level conversion of the voltage signals of the decoder 713 at a logic level to a level allowing the analog switch AS of the analog switch array 715 to operate.

The analog switch AS of the analog switch array 715 is turned on/off (opened and closed) corresponding to the output from the decoder 713 provided through the level shifter 714.

The analog switch AS of the analog switch array 715 is connected to the individual electrode 14 of the piezoelectric element 11, and to the analog switch AS, the drive waveform PV from the drive waveform generator 701 is input. Thus, the analog switch AS is turned on corresponding to the result of decoding the image data (gradation data) and the selection signals, which have been serially transferred, by the decoder 713. Thus, drive pulses (or waveform elements) contained in the drive waveform PV pass (are selected) and are supplied to the individual electrode 14 of the piezoelectric element 11.

Note that, in the present embodiment, the controller 500 and the head driver 509 constitute a head drive control device or a head drive controller according to an embodiment of the present disclosure including an actuator drive control device according an embodiment of to the present disclosure.

Figure 9:
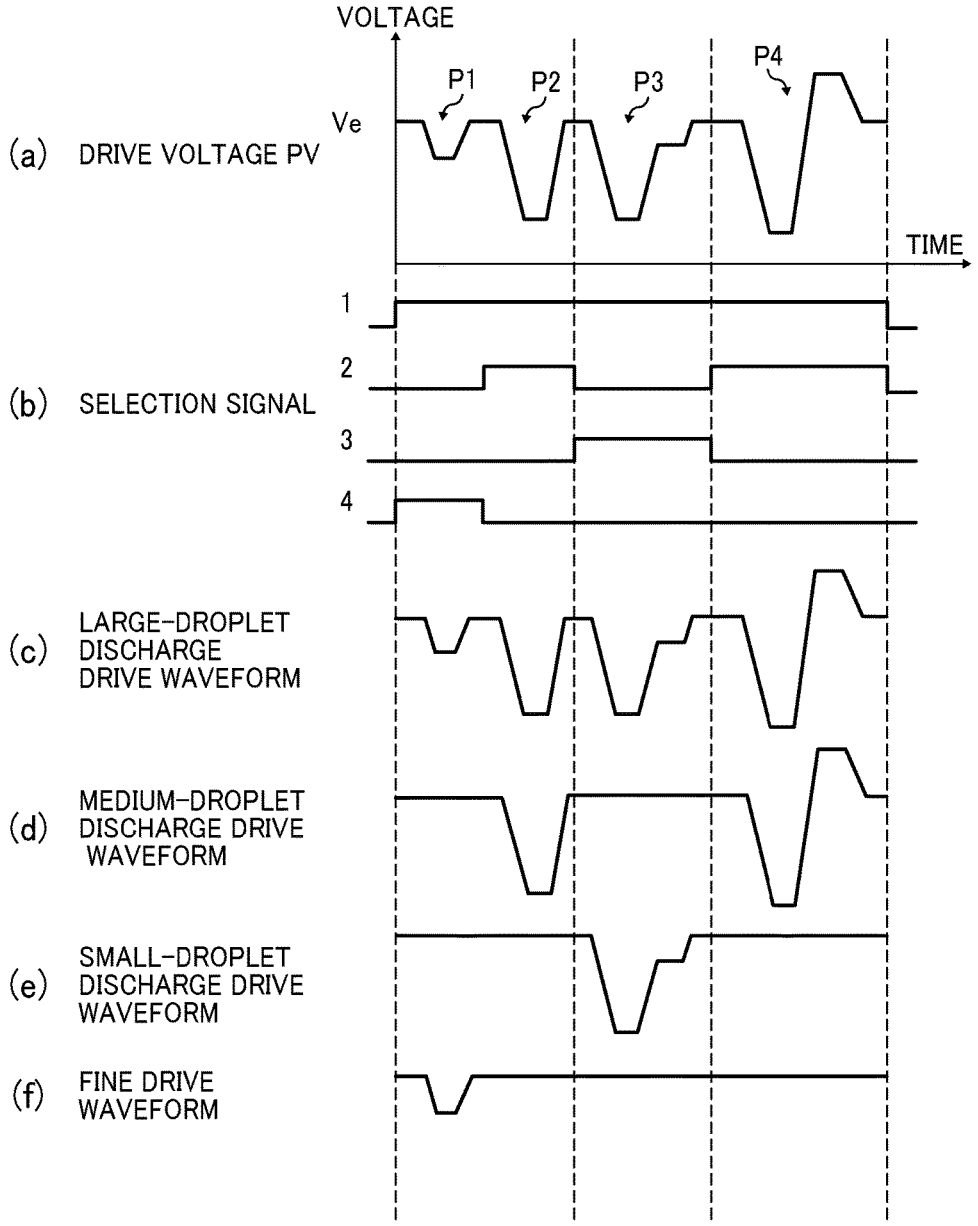
FIG. 9 is an illustration of an example of a drive waveform, selection signals, discharge drive waveforms, and a non-discharge drive waveform according to an embodiment of the present disclosure.

Next, an example of the drive waveform, the selection signal, a discharge drive waveform, and a non-discharge drive waveform is described with reference to FIG. 9. FIG. 9 is an illustration of the waveforms.

As illustrated in (a) of FIG. 9, the drive waveform PV is a waveform including drive pulses P1 to P4 in time series in one drive period (one printing period).

The drive pulse P1 is a fine drive pulse (non-discharge pulse) causing meniscus to ripple to the extent not to discharge the liquid. The drive pulse P1 includes a pulling waveform element that falls from an intermediate potential Ve as a reference potential to expand the individual liquid chamber 6, a holding waveform element that holds a falling potential by the pulling waveform element, and a pushing waveform element that rises from the potential held by the holding waveform element to the intermediate potential Ve to contract the individual liquid chamber 6.

The drive pulse P2 is a discharge pulse to discharge the liquid. The drive pulse P2 includes a pulling waveform element, a holding waveform element, and a pushing waveform element.

The drive pulse P3 is a discharge pulse to discharge the liquid. The drive pulse P3 includes a pulling waveform element, a holding waveform element, and a pushing waveform element that rises from the falling potential to the intermediate potential Ve in two steps.

The drive pulse P4 is a discharge pulse to discharge the liquid. The drive pulse P4 includes a pulling waveform element, a holding waveform element, a pushing waveform element that rises from the falling potential beyond the intermediate potential Ve, a holding waveform element that holds the potential risen in the pushing waveform element, and a pulling waveform element that falls to the intermediate potential Ve.

As illustrated in (b) FIG. 9, a selection signal 1 is a signal that selects all the drive pulses P1 to P4 that form the drive waveform PV. With the selection signal 1, a large droplet discharge drive waveform illustrated in (c) of FIG. 9 is applied to the piezoelectric element 11, and large droplets are discharged.

A selection signal 2 is a signal that selects the drive pulses P2 and P4 of the drive waveform PV. With the selection signal 2, a medium droplet discharge drive waveform illustrated in (d) of FIG. 9 is applied to the piezoelectric element 11, and medium droplets are discharged.

A selection signal 3 is a signal that selects the drive pulse P3 of the drive waveform PV. With the selection signal 3, a small droplet discharge drive waveform illustrated in (e) of FIG. 9 is applied to the piezoelectric element 11, and small droplets are discharged.

A selection signal 4 is a signal that selects the drive pulse (non-discharge pulse) P1 of the drive waveform PV. With the selection signal 4, a fine drive waveform illustrated in (f) of FIG. 9 is applied to the piezoelectric element 11, and the meniscus is finely driven.

Figure 10:
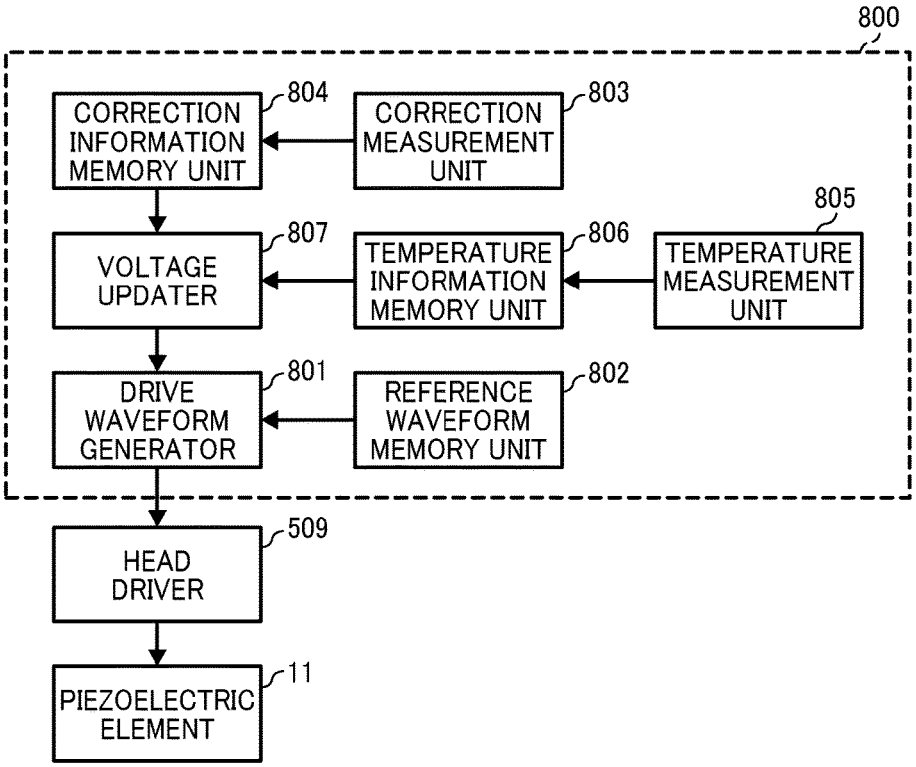
FIG. 10 is a block diagram of an example of a configuration of a head drive control device according to an embodiment of the present disclosure including an actuator drive control device according to an embodiment of the present disclosure.

Next, an example of a configuration of a head drive control device according to an embodiment of the present disclosure including an actuator drive control device according to an embodiment of the present disclosure is described with reference to the block diagram of FIG. 10.

In an actuator drive control device 800, a drive waveform generator 801 reads data of a reference drive waveform stored in a reference waveform memory unit 802, performs D/A conversion, current amplification, and voltage amplification, as described above, to generate the drive waveform PV, and outputs the generated drive waveform PV to the head driver (driver IC) 509 as a drive unit.

A correction measurement unit 803 measures time (application time) for which the drive waveform PV is being applied to the piezoelectric element 11, here, accumulated time of the application time for which the intermediate potential Ve of the drive waveform PV is applied.

The measurement result of the correction measurement unit 803 is stored and held in a correction information memory unit 804. At this time, the correction information memory unit 804 holds updated accumulated time of the application time of the intermediate potential Ve from when a drive voltage value of the drive waveform PV was updated to a large value in previous time (this timing is called "voltage updated timing").

A temperature measurement unit 805 measures an environmental temperature (head temperature) on the basis of the detection result of the temperature detector 80. The measured temperature measured in the temperature measurement unit 805 is stored and held in a temperature data memory unit 806.

The voltage updater 807 updates the voltage value of the drive waveform PV with time. Here, the voltage updater 807 updates the voltage value (a peak value of a positive-side voltage in the present embodiment) of the drive waveform PV to a large value when the accumulated time of the application time of the intermediate potential Ve measured in the correction measurement unit 803 reaches a time interval to update the voltage value of the drive waveform PV, which is set in advance (the time interval is simply referred to as "update interval").

Here, in the update of the voltage value of the drive waveform PV, the voltage values (peak values) of the waveform element, of the drive pulses P1 to P4, to the intermediate potential Ve are made large by correction to make the intermediate potential Ve high while leaving the falling potential of the pulling waveform element unchanged.

Further, the update interval by the voltage updater 807 is set to become longer as the number of times of update becomes larger. Here, the update interval to the update of the next time is made longer than the update interval of this time (the update interval is made longer little by little) in every update. Note that the update interval can be made long after the same update interval is repeated multiple times (the update interval can be made stepwisely long).

The correction of the intermediate potential Ve by the voltage updater 807 is also changed or adjusted on the basis of the measurement result of the environmental temperature stored in the temperature data memory unit 806.

In such a case, when the voltage updater 807 includes a table in which the update interval and an updated value of the voltage value of the drive waveform PV are associated, the update value can be easily obtained. Further, at this time, when the voltage updater 807 includes a plurality of table in which the update interval and the updated value are set according to the environmental temperature, the updated interval and the update value can be easily obtained according to the environmental temperature stored in the temperature data memory unit 806.

Figure 11:
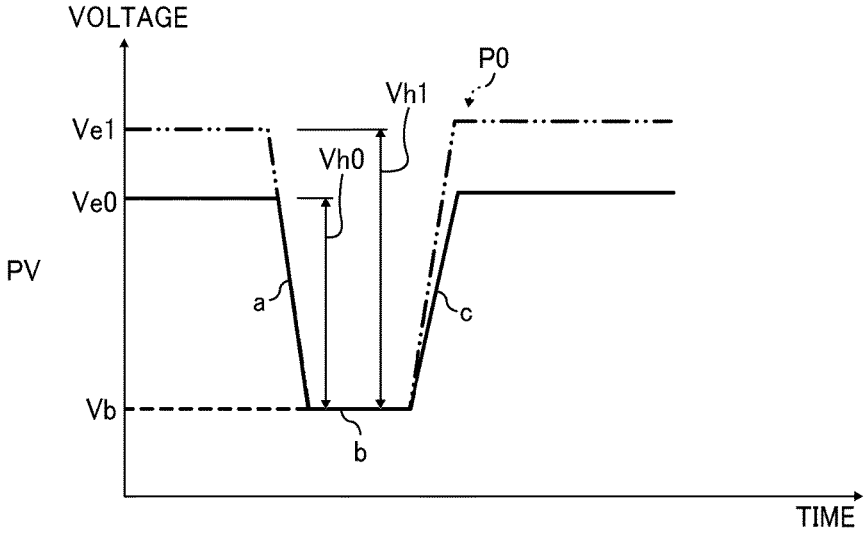
FIG. 11 is an illustration of an example of one drive pulse of update of a voltage value of the drive waveform according to an embodiment of the present disclosure.

Next, correction of the voltage value of the drive waveform is described with reference to FIG. 11. FIG. 11 is an illustration of an example of one drive pulse to correct the voltage value of the drive waveform.

A drive pulse P0 includes, as described above, a pulling waveform element a that falls from the intermediate potential Ve as a reference potential to a potential Vb to expand the individual liquid chamber 6, a holding waveform element b that holds the falling potential Vb, and a pushing waveform element c that rises from the potential Vb held in the holding waveform element b to the intermediate potential Ve to contract the individual liquid chamber 6 to discharge the liquid. Note that the pushing waveform element c includes a waveform element that rises in a plurality of steps, as described above, and a waveform element that rises to a potential beyond the intermediate potential Ve.

In the update processing (control) of the voltage value of the drive waveform PV, the intermediate potential Ve is corrected to a high value. For example, as illustrated in FIG. 11, an intermediate potential Ve0 is corrected to an intermediate potential Ve1. At this time, the falling potential Vb by the pulling waveform element a is unchanged.

Accordingly, a potential difference (voltage value) between the intermediate potential Ve and the falling potential Vb becomes large. That is, in the example illustrated in FIG. 11, the voltage value of the drive waveform (drive pulse P) of when the intermediate potential Ve is the potential Ve0 is a peak value Vh0. In contrast, when the intermediate potential Ve is corrected to a high potential like the potential Ve1, the voltage value of the drive waveform (drive pulse P) becomes a peak value Vh1 (Vh1>Vh0), which is a large value.

Note that the updated value (correction value) of the voltage value is, but not limited to, a value by which approximately the same (including the same) discharge speed as an initial discharge speed can be obtained after the update.

With the application of the drive waveform to the piezoelectric element 11, as described above, the voltage value (the peak value of the drive pulse) of the drive waveform is raised with respect to the variation of the displacement amount of the piezoelectric element (a decrease in the displacement amount) caused with time, whereby the decreased displacement amount is supplemented and a desired displacement amount can be secured, and the variation can be suppressed.

Figure 12:
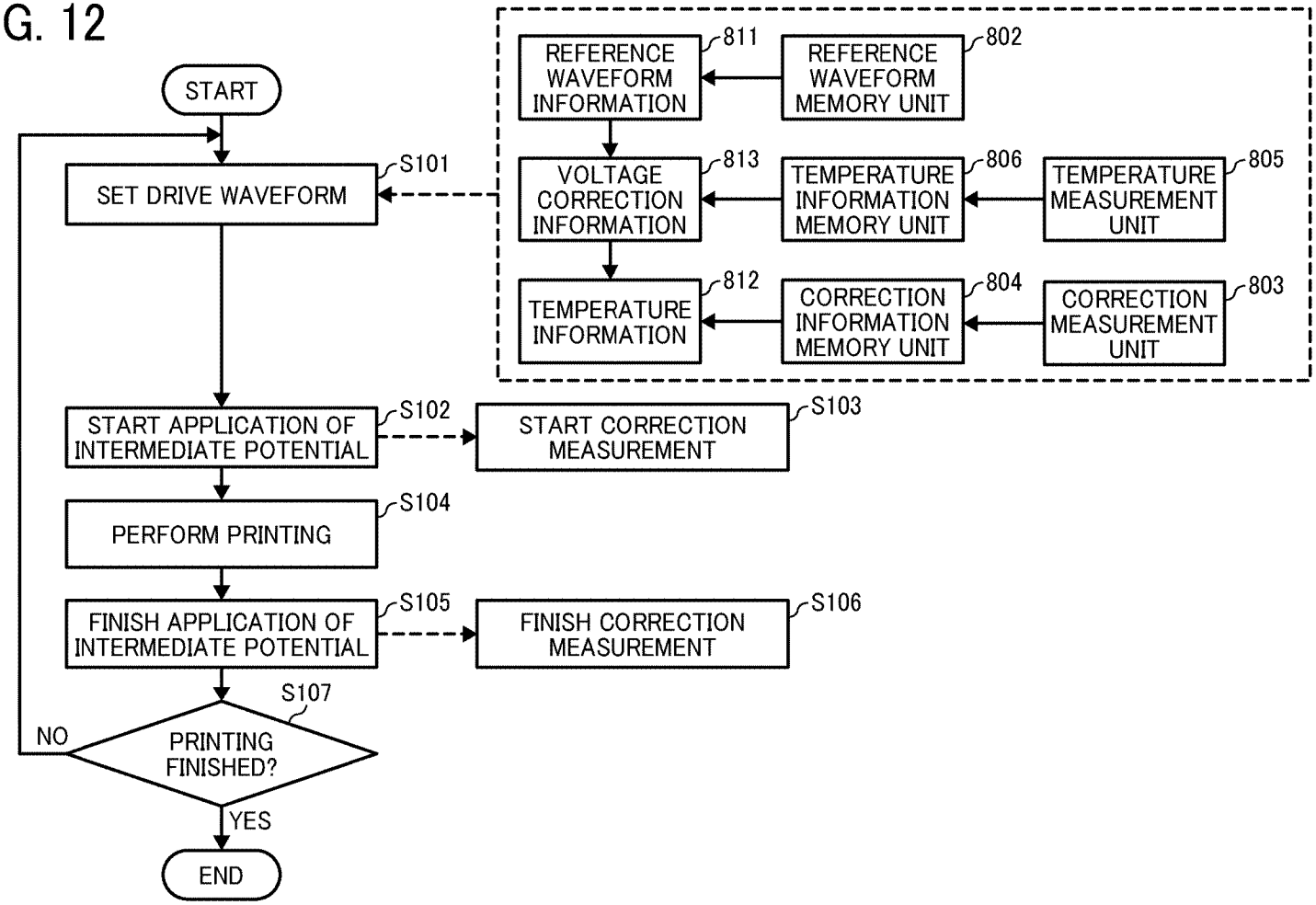
FIG. 12 is an illustration of measurement of application time of an intermediate potential in update control of the voltage value of the drive waveform.

Next, measurement of the application time of the intermediate potential in the update control of the voltage value of the drive waveform is described with reference to FIG. 12. FIG. 12 is a flowchart with a block diagram used for the description.

First, the drive waveform PV is set. At S101, the drive waveform PV is set on the basis of reference waveform information 811 stored in the reference waveform memory unit 802, voltage correction information 812 stored in the correction information memory unit 804, and temperature information 813 stored in the temperature data memory unit 806.

When the application of the intermediate potential Ve of the drive waveform PV is started at S102, at S103 the correction measurement unit 803 starts measurement (correction measurement) of the application time of the intermediate potential Ve.

At S104, printing is started. During printing (during application of the drive waveform PV to the piezoelectric element 11), the correction measurement unit 803 continues the measurement of the application time of the intermediate potential Ve.

When the application of the intermediate potential Ve of the drive waveform PV is finished at S105, at S106 the correction measurement unit 803 finishes the measurement (correction measurement) of the application time.

When printing is not finished (NO at S107), the process goes back to S101. The above-described measurement of the application time is repeatedly performed until the printing is finished (YES at S107).

Accordingly, the accumulated time of the application time of the intermediate potential Ve of the drive waveform PV is stored in the correction information memory unit 804. Note that the accumulated time in the correction information memory unit 804 is reset when the voltage value of the drive waveform PV is updated.

Figure 13:
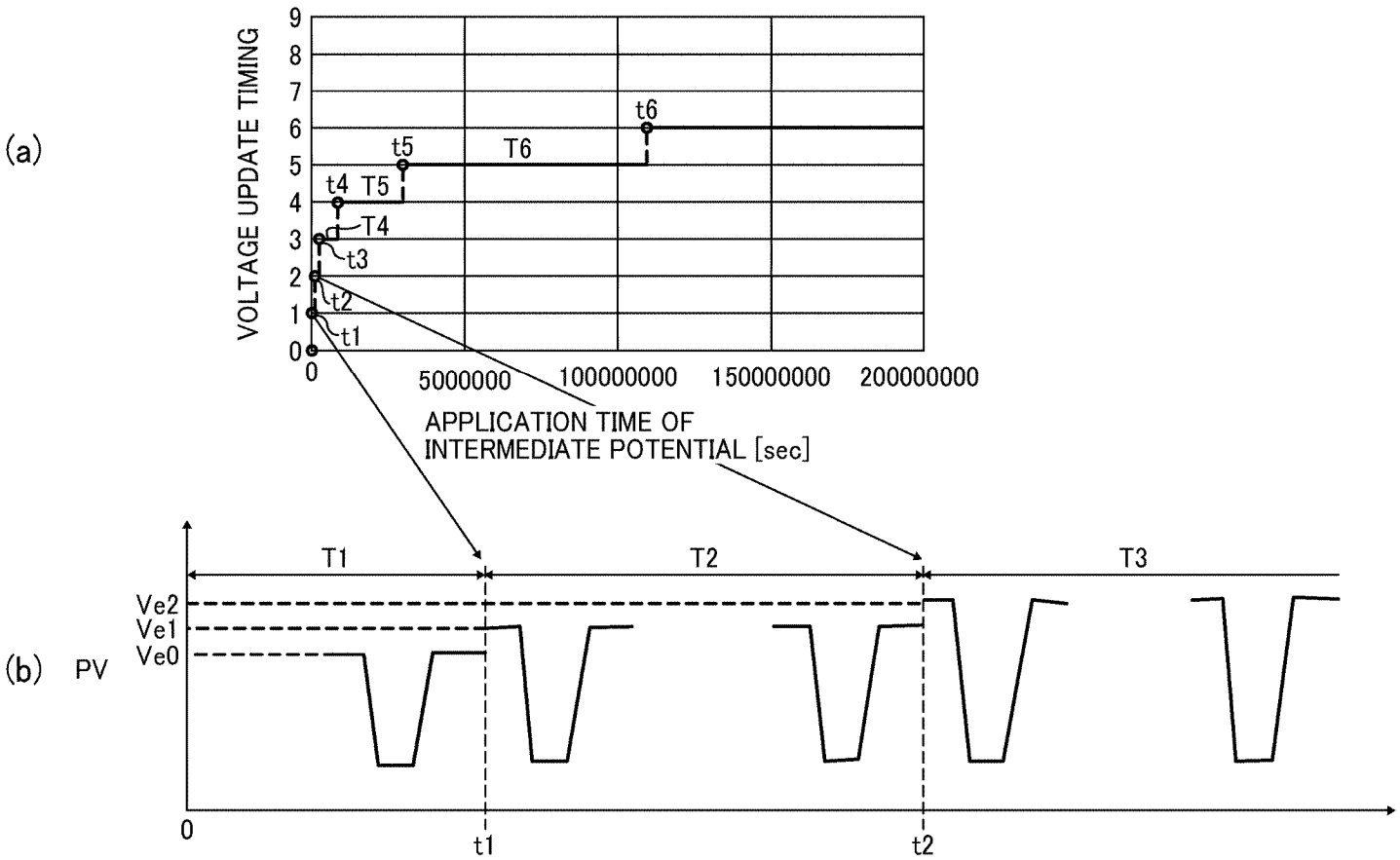
FIG. 13 is an illustration of an example of update of the voltage value of the drive waveform according to an embodiment of the present disclosure.

Next, an example of the update of the voltage value of the drive waveform is described with reference to FIG. 13. FIG. 13 is an illustration used for the description, and (a) of FIG. 13 is a graph of an example of a relationship between a measurement time of the intermediate potential and voltage update timing and (b) of FIG. 13 is a chart of the drive waveform of a case where the voltage update is performed.

In this example, as illustrated in (a) of FIG. 13, timing to update the intermediate potential Ve of the drive waveform PV to a high value (this timing is referred to as "voltage update timing") is when an integrated accumulated time that is an integration of the accumulated time of the application time from when the application of the intermediate potential Ve of the drive waveform PV to the piezoelectric element 11 is started reaches time (points of time) t1, t2, t3, t4, t5, and t6. Further, time to be measured is time used for application of the intermediate potential Ve. The time used for application of the intermediate potential Ve is not time of an update interval T2 of (b) of FIG. 13, and is time for which the voltage Ve1 is actually being applied in the update interval T2.

In this case, an interval (time) from when the application of the intermediate potential Ve is started (0) to the time t1 is an update interval T1. Similarly, an interval of time t1 to t2 is an update interval T2, . . . , and an interval of time t5 to t6 is an update interval T6. Note that, in the present embodiment, the update is not performed after the update of sixth time is terminated.

Here, in a case of performing the update at the time t1, t2, t3, t4, t5, and t6, for example, the accumulated time of the application time of the drive waveform PV from each voltage update timing is measured, and the update can be performed when the accumulated time reaches the time interval to the next voltage update timing.

Alternatively, the integrated accumulated time that is an integration of the accumulated time of the application time of the drive waveform PV from a start of use of the piezoelectric element 11 is measured, and the update can be performed when the integrated accumulated time reaches a cumulative time interval that is integration of the time intervals of the update. For example, the update can be performed at the time t2 when the integrated accumulated time reaches an update interval T1+T2 as the cumulative time interval.

Then, in the present embodiment, the update intervals T1 to T6 are set to become longer little by little (in every update) as the number of times of update is increased. For example, T1<T2<T3 . . . <T6 is set. That is, the time interval of the update includes a time interval that becomes longer as the number of times of update is increased.

In this case, the update interval is preferably set to become exponentially longer. That is, since the discharge speed becomes exponentially slower as the accumulated time of the application time of the intermediate potential Ve to the piezoelectric element 11 becomes longer, it is preferable to perform the voltage update while exponentially changing the update interval.

Then, as illustrated in (b) of FIG. 13, the intermediate potential Ve is corrected from the potential Ve0 to the higher potential Ve1 (Ve1>Ve0) at the first voltage update timing (time) t1. The intermediate potential Ve is corrected from the potential Ve1 to a higher potential Ve2 (Ve2>Ve1) at the next voltage update timing (time t2). Similarly, correction (update) to make the intermediate potential Ve high is performed at every voltage update timing.

Note that the voltage value is schematically changed to become high at voltage correction timing. However, it is preferable to change the voltage value after dropping the voltage once at the voltage correction timing.

That is, in a case of applying the voltage exceeding the coercive electric field of the piezoelectric element to perform driving, using the electromechanical transducer element, in particular, a piezoelectric element that is flexurally deformable, variation of decrease in the displacement amount of the piezoelectric element occurs, and this variation is related to the accumulated time for which the voltage is applied.

Meanwhile, in the case of applying the voltage exceeding the coercive electric field of the piezoelectric element to perform driving, a temporal characteristic variation amount does not substantially depend on the voltage value and the characteristic variation amount gradually converges in the long term. Accordingly, if the update interval is made short in every update, the voltage becomes excessively high, resulting in facilitation of deterioration of the piezoelectric element.

Hence, in the present embodiment, the time interval of the update is made gradually longer while the update to make the voltage value of the drive waveform high is performed with time. Accordingly, the characteristic variation of the electromechanical transducer element can be suppressed and the variation of the discharge characteristics can be suppressed without imposing excessive burden on the electromechanical transducer element through excessive voltage correction.

Figure 14:
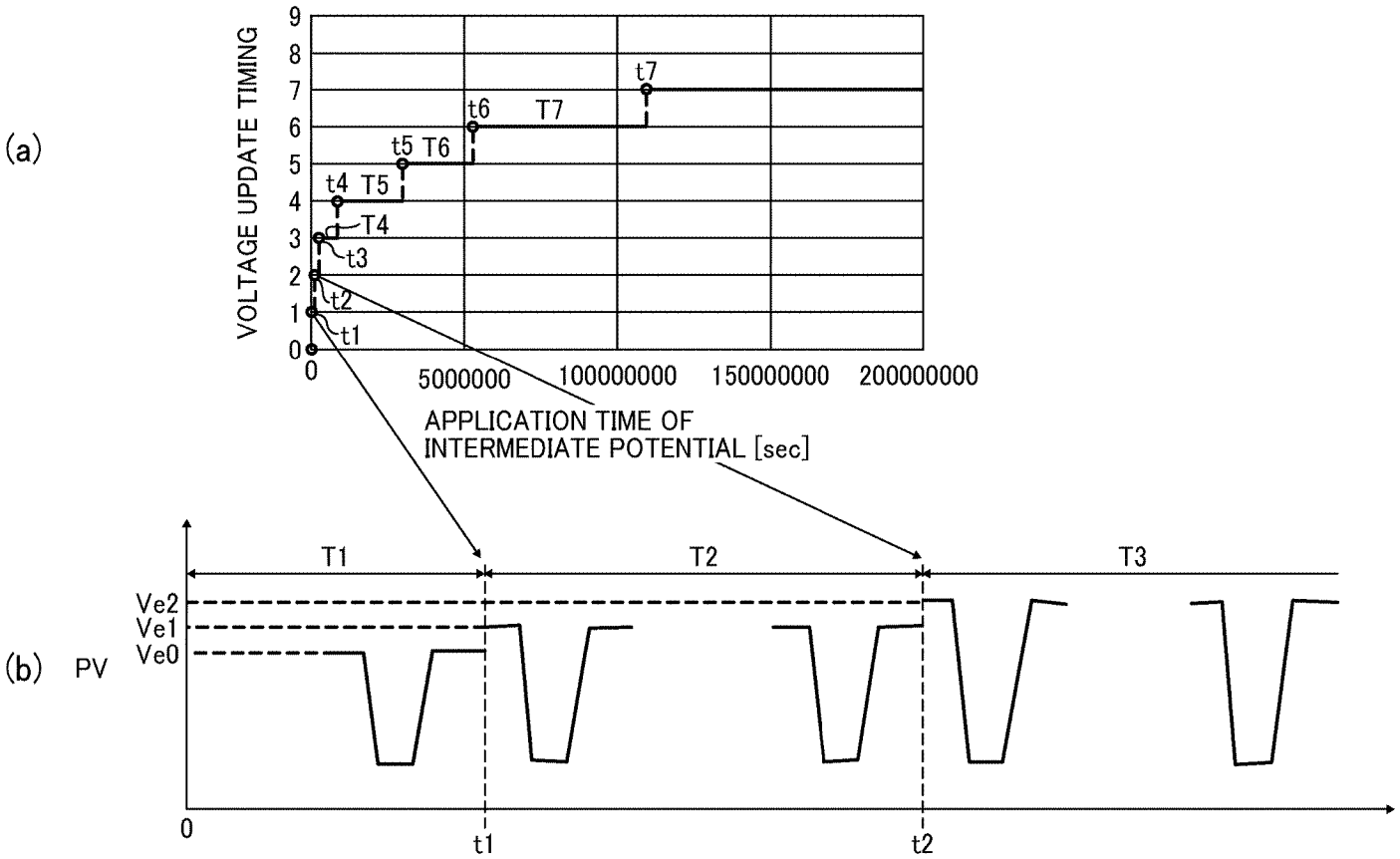
FIG. 14 is an illustration of another example of the update of the voltage value of the drive waveform according to an embodiment of the present disclosure.

Next, another example of the update of the voltage value of the drive waveform is described with reference to FIG. 14. FIG. 14 is an illustration used for the description, and (a) of FIG. 14 is a graph of an example of a relationship between the measurement time of the intermediate potential and the voltage update timing and (b) of FIG. 14 is a chart of the drive waveform of when the voltage update is performed.

In this example, the time interval of the update includes a time interval that is longer than repeated time intervals after the same time interval is repeated multiple times. As illustrated in (a) of FIG. 14, an update interval T5 and an update interval T6 are the same time interval, and an update interval T7 is longer than the update intervals T5 and T6.

If the time interval of the update includes a time interval that becomes longer as the number of times of update is increased in this way, repetition of the same update interval can be partially included.

Figure 15:
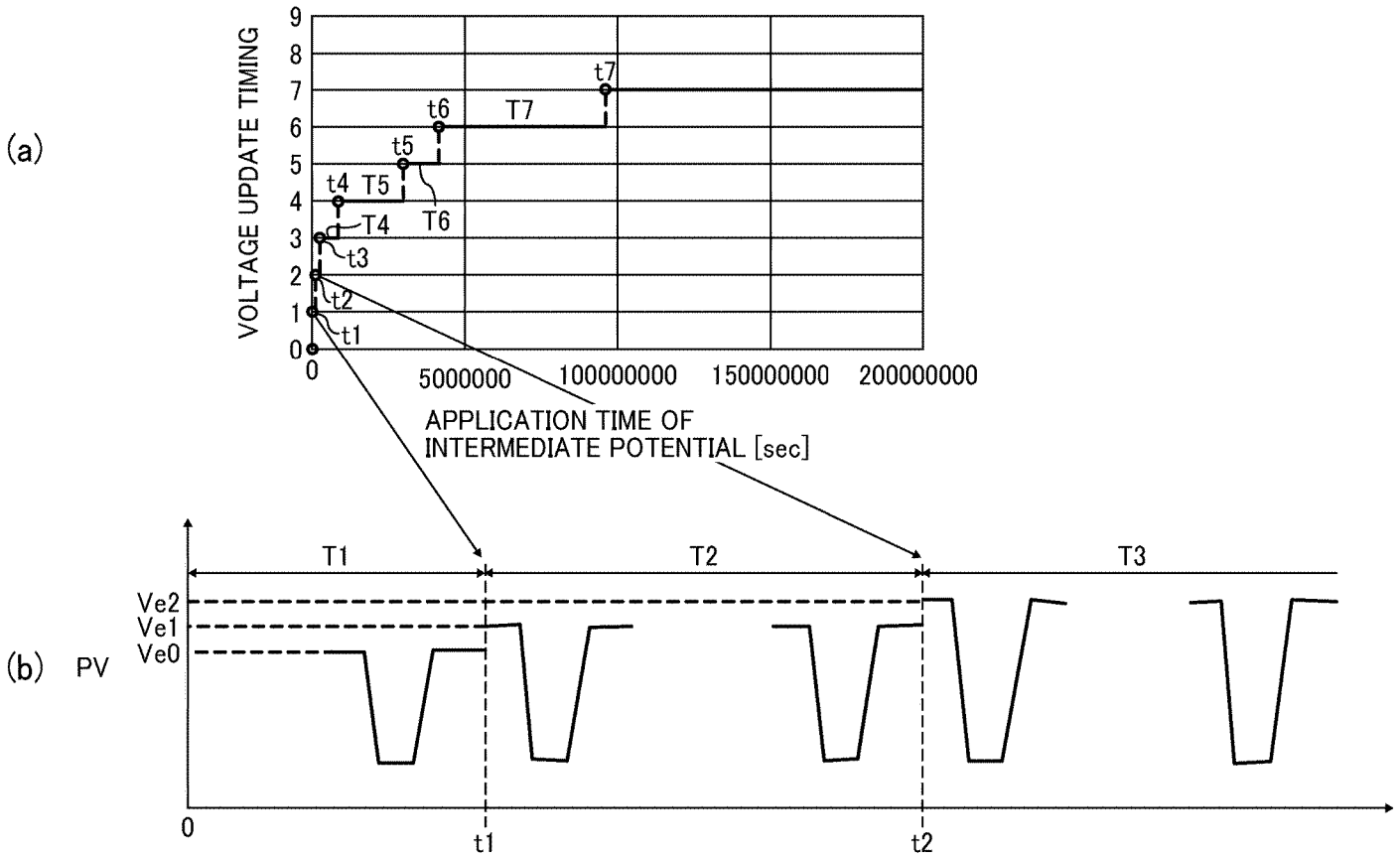
FIG. 15 is an illustration of still another example of the update of the voltage value of the drive waveform according to an embodiment of the present disclosure.

Next, still another example of the update of the voltage value of the drive waveform is described with reference to FIG. 15. FIG. 15 is an illustration used for the description, and (a) of FIG. 15 is a graph of an example of a relationship between the measurement time of the intermediate potential and the voltage update timing and (b) of FIG. 15 is a chart of the drive waveform of when the voltage update is performed.

In the example, the time interval of the update includes a time interval that becomes shorter than the time interval before the update when the number of times of update is increased. As illustrated in (a) of FIG. 15, the update interval T6 is shorter than the previous update interval T5. Then, the update interval T7 next to the update interval T6 is longer than the update interval T5.

If the time interval of the update includes a time interval that becomes longer as the number of times of update is increased in this way, the time interval that becomes shorter than the previous time interval time can be included in the middle of repetition of the update.

Next, examples are illustrated.

Manufactured examples of the liquid discharge head used in the evaluation of examples and comparative examples are described below.

The diaphragm plate 3 was produced by forming $SiO_2$ (film thickness 600 nm), Si (film thickness 200 nm), $SiO_2$ (film thickness 100 nm), SiN (film thickness 150 nm), $SiO_2$ (film thickness 1300 nm), SiN (film thickness 150 nm), $SiO_2$ (film thickness 100 nm), Si (film thickness 200 nm), and $SiO_2$ (film thickness 600 nm) in the recited order on a 6-inch silicon wafer.

Thereafter, as an adhesive film adhering to the lower electrode 13, a titanium film (film thickness 20 nm) was formed at a film formation temperature of 350° C. using a sputtering apparatus, and then was thermally oxidized at 750° C. using rapid thermal annealing (RTA). Subsequently, as a metal film, a platinum film (film thickness 160 nm) was formed at a film formation temperature of 400° C. using a sputtering apparatus, to form the lower electrode 13.

Subsequently, a solution adjusted so as to have a ratio of Pb:Ti=1:1 as a $PbTiO_3$ layer serving as a base layer and a solution adjusted so as to have a ratio of Pb:Zr:Ti=115:49:51 as an electromechanical transducer film were prepared, and a film was formed by a spin coating method.

For synthesis of a precursor coating liquid, lead acetate trihydrate, titanium isopropoxide, and zirconium isopropoxide were used as starting materials. Crystal water of lead acetate was dissolved in methoxyethanol and was then dehydrated. The amount of lead is excessively large for a stoichiometric composition, to prevent reduction in crystallinity by so-called lead missing during heat treatment.

The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor solution was synthesized. The concentration of PZT was prepared to be 0.5 mol/l. The PT solution was prepared in a similar manner to the PZT solution.

Using the PT and PZR precursor solutions, first, a PT layer film was formed by spin coating. After film formation, the PT layer film was dried at 120° C. Thereafter, a film was formed by spin coating using the PZT solution, was dried at 120° C., and then was subjected to pyrolysis at 400° C. The third layer was subjected to pyrolysis, and then was subjected to a crystallization heat treatment (temperature 730° C.) by RTA. At this time, the film thickness of PZT was 240 nm. This step was performed eight times (24 layers) in total to obtain a PZT film thickness of about 2 μm (in the piezoelectric layer 12).

Subsequently, a $SrRuO_3$ film (film thickness 40 nm) was formed by sputtering as an oxide film of the upper electrode 14, and a Pt film (film thickness 125 nm) was formed by sputtering as a metal film. Then, a film was formed by the spin coating method using a photoresist (TSMR8800) manufactured by TOKYO OHKA KOGYO., LTD, a resist pattern was formed by a normal photolithographic method, and an electrode pattern was manufactured using an ICP etching device (manufactured by SAMCO INC.).

Subsequently, an $Al_2O_3$ film of 50 nm was formed using an ALD method as the insulation film 21. As raw materials, TMA (Sigma-Aldrich Corporation) for Al and $O_3$ generated by an ozone generator for O were stacked alternately, and film formation was thereby performed. Then, contact hole portions were formed by etching.

Thereafter, a film of Al was formed by sputtering as metal wiring. Patterning was formed by etching. A film of $Si_3N_4$ was formed by plasma CVD so as to have a film thickness of 500 nm as the insulation film to produce the piezoelectric element 11. The piezoelectric elements 11 were designed such that 300 pieces were arranged in a row in one chip.

A bonding step to bond the holding substrate 50 was formed by a similar step. The bonding step was disposed at a position corresponding to a partition wall of the individual liquid chamber 6. In the step of forming the insulation film, the same layers as the insulation film 21, the metal wiring, and the insulation film 22 were formed at a position corresponding to the partition wall of the individual liquid chamber 6. In other words, the bonding step was formed by stacking the same layer as the insulation film 21, the same layer as the metal wiring, and the same layer as the insulation film 22. The bonding step was not disposed in an activation portion of the piezoelectric element 11, was not disposed outside the partition wall of the individual liquid chamber 6, but was formed at a position having no influence on the vibration portion 30 of the diaphragm plate 3.

Then, polarization processing was executed by corona charging. For the corona charging, a tungsten wire of φ50 μm was used, and a stainless steel grid electrode having an opening ratio of 60% was used as a grid electrode. Polarization processing was performed under the following conditions. That is, a processing temperature was 80° C., a corona voltage was 9 kV, a grid voltage was 1.5 kV, processing time was 30 seconds, a distance between a corona electrode and the grid electrode was 4 mm, and a distance between the grid electrode 62 and the stage 63 was 4 mm.

Further, a common electrode connection pad and individual electrode connection pads were formed. The distance between the individual electrode connection pads was 80 μm.

Then, an Si wafer was etched, and the individual liquid chamber 6 (the width of 60 μm) was formed. To hold the individual liquid chamber 6, Si etching was conducted from a back surface of the wafer after the holding substrate 50 was bonded. An opening width of the recess 52 of the holding substrate 50, which covers the piezoelectric element 11, was 75 μm. After that, other members were assembled, and the liquid discharge head was completed.

Figure 16:
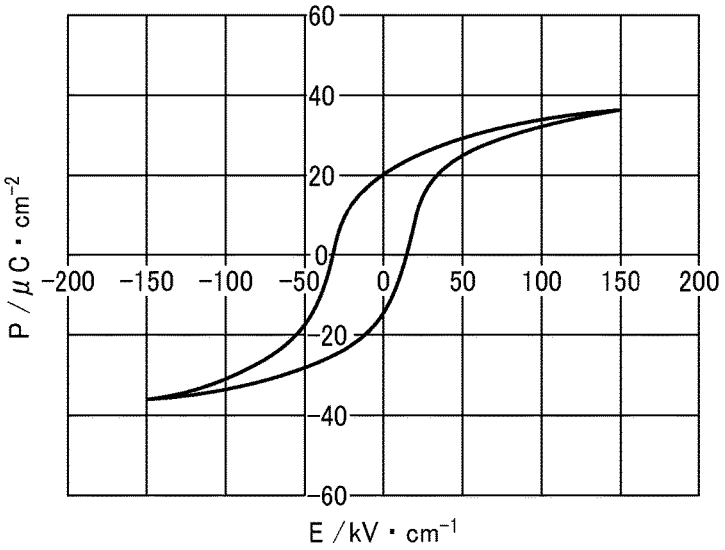
FIG. 16 is a graph of an example of a P-E hysteresis loop of piezoelectric element used in embodiments and comparative examples of the present disclosure.

Note that the P-E hysteresis loop of the piezoelectric element 11 obtained by the above-described manufacturing method is illustrated in FIG. 16.

Variation evaluation of the discharge speed was conducted using the produced liquid discharge head. Hereinafter, as an expression of a voltage, a potential state of the piezoelectric element is defined. A voltage of the drive waveform is applied to the individual electrodes, and a bias voltage is applied to the common electrode, so that a voltage waveform is made. Note that there is no substantial difference even if the voltage waveform to be applied to the piezoelectric element is controlled only with the individual electrodes.

Example 1

The drive waveform PV (drive pulse P0) illustrated in FIG. 11 was applied to the piezoelectric element, and the variation evaluation of the discharge speed was conducted. Here, the application time of the intermediate potential Ve of the drive waveform PV was continuously measured, and when the application time reaches predetermined timing, the voltage value (intermediate potential Ve) of the drive waveform PV was updated. An update voltage value (increased voltage value) was, for example, 0.3 V.

As described above, the update interval becomes exponentially longer, and the interval up to the next voltage update timing is longer than the interval up to the previous voltage update timing. That is, the update interval of the voltage correction is expressed by y=b*exp(ax), "x" is a predetermined number of times of voltage update timing, and "y" is the application time of the intermediate potential Ve.

In the present example, the update interval was determined where a=1.3 and b=4500. Further, the update width (correction value) of the voltage value at the voltage update timing was updated to have a voltage value by which a discharge speed Vj becomes an initial state. The environmental temperature was 25° C. (ordinary temperature).

Example 2

The same conditions as Example 1 were employed except that the environmental temperature was 10° C.

Example 3

The same condition as Example 1 were employed except that the environmental temperature was 40° C.

Example 4

The same conditions as Example 1 were employed except that the update interval was determined where a=1.3 and b=5000, and the update width of the voltage value at the voltage update timing was updated to have a voltage value by which the discharge speed Vj becomes a speed slightly faster than the initial state.

Comparative Example 1

The same conditions as Example 1 were employed except that the update was repeated at constant update intervals (the first update interval of Example 1).

Comparative Example 2

The same conditions as Example 1 were employed except that the update interval was shorter than the first update interval of Example 1 in every update.

Figure 17:
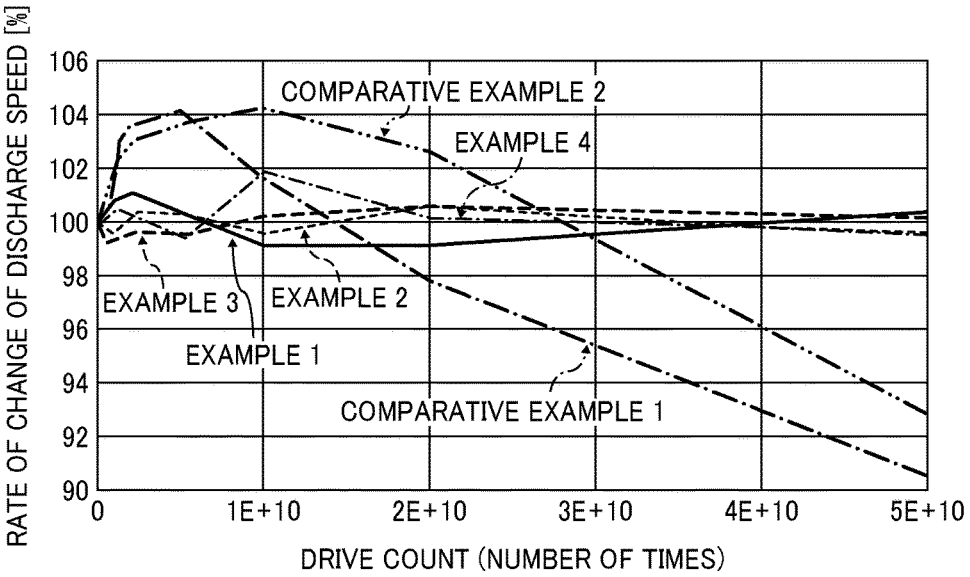
FIG. 17 is an illustration illustrating measurement results of the number of times of driving and a rate of change of discharge speed in examples and comparative examples according to an embodiment of the present disclosure.

Rates of change of the discharge speed Vj in Examples 1 to 4 and Comparative Examples 1 and 2 were evaluated. Results of the evaluation are illustrated in FIG. 17. Note that the rate of change of the initial discharge speed Vj was 100%, and the evaluation was started when the number of times of driving was zero.

Further, the rates of change of the discharge speed at the point of time when the number of times of driving was 5^10 times, and variation of the discharge speed up to the 5^10 times were evaluated. The results are illustrated in FIG. 18. Note that, in FIG. 18, "very good" means that the speed variation is extremely small, "good" means that the rate of change of speed or the speed variation is small, "poor" means that the rate of change of speed or the speed variation is large.

It has been found that the discharge speed Vj remains at nearly 100% by the correction of the voltage values of the drive waveform together with the environmental temperatures according to the evaluation results of Examples 1 to 3. From this fact, appropriate correction can be made at the environmental temperatures.

Further, at any of the environmental temperatures, the discharge speed Vj can be corrected by the same technique. Therefore, discharge speed update timing according to the temperatures can be set. Since the voltage value of the drive waveform differs depending on the temperature, appropriate update intervals at the temperatures can be set and the voltage values can also be determined.

Further, setting of the integrated accumulated time at each of the temperatures is not necessary, and the time for which the intermediate potential is applied to the piezoelectric element may just be measured. This is because variation of characteristics does not substantially depend on the voltage value in a case where the voltage exceeds the coercive electric field of the piezoelectric element although the voltage value of the discharge waveform may vary depending on the temperature.

Further, in Example 4, there is timing when the discharge speed Vj is slightly fast. Therefore, when comparing Example 1 and Example 4 at the same environmental temperature (25° C.), Example 1 (b=4500) is preferable. When going through the number of times of driving, Example 4 has little difference in the result from Example 1. Therefore, for example, in a case where there is a sufficient margin in upper and lower limit values of the discharge speed Vj in which print quality can be secured, the update interval can be made longer by correction of the voltage to have a voltage value by which the discharge speed becomes slightly faster than the initial discharge speed Vj.

Meanwhile, in Comparative Example 1, the voltage was continuously corrected at fixed update intervals, and thus the discharge speed was gradually larger (faster) than 100%. Further, in this case, the voltage was continuously corrected, the voltage reached a voltage upper limit of the drive waveform, and after that, the voltage was not able to be corrected. In Comparative Example 2, the voltage update timing was early, and thus the discharge speed Vj was larger than 100% and was gradually lowered.

Here, a coefficient to determine the update interval can be determined according to various characteristics such as a characteristic of the piezoelectric element, the rigidity of the head, and the viscosity of the liquid. The update interval can be made gradually long because the temporal characteristic variation amount of the piezoelectric element gradually converges (an initial change amount is large, and the change amount becomes smaller as the number of times of driving is increased) over the driving time (accumulated time).

Therefore, the variation of the discharge speed can be suppressed by making the update interval gradually longer.

Further, the variation of the discharge speed at this time is exponentially changed (becomes slower), and thus definition by an exponential function is particularly preferable in determining the update interval.

Further, as described above, the application time of the intermediate potential of the drive waveform is measured when the time (application time) up to the voltage update timing is measured. Accordingly, as illustrated in FIG. 9, even if the drive waveform includes a plurality of drive pulses, the time reaching the update interval is measured and the voltage value can be corrected by measurement of the intermediate potential.

Further, the voltage value of the drive waveform was corrected by measurement of time. However, other references can be employed as long as there is such information. For example, the number of times of application of the drive waveform may be employed. In this case, y can be expressed from a relationship between the number of times of driving and the waveform length of the drive waveform.

Note that, in the above-described embodiment, a configuration in which the actuator drive control device is included in the head drive control device that drives and controls the piezoelectric actuator of the liquid discharge head has been described. However, the actuator is not limited to the one that drives and controls the actuator including the electromechanical transducer element of the liquid discharge head.

Further, processing of the update of the voltage value of the drive waveform, the measurement of the application time of the drive waveform, and the like in the embodiment is performed by the computer of the main controller according to the programs according to an embodiment of the present disclosure.

In embodiments of the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

For example, the liquid discharge head and a head tank are integrated as the liquid discharge device. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. The liquid discharge device may include the liquid discharge head, the carriage, and the main scan moving unit that are integrated as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Further, in another example, the liquid discharge device includes tubes connected to the head tank or the channel member mounted on the liquid discharge head so that the liquid discharge head and the supply assembly are integrated as a single unit. Liquid is supplied from a liquid reservoir source to the liquid discharge head.

The main-scan moving unit may be a guide only. The supply unit may be a tube(s) only or a loading unit only.

The term "liquid discharge apparatus" used herein also represents an apparatus including the liquid discharge head or the liquid discharge device to discharge liquid by driving the liquid discharge head. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the liquid discharge apparatus further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head including an actuator including an electromechanical transducer element; and a head drive controller to control the liquid discharge head, the head drive controller including:

a drive waveform generator to generate a drive waveform to be applied to the electromechanical transducer element; and a voltage updater to update a voltage value of the drive waveform to a larger value with an elapse of time, the voltage updater to set a time interval of update of the voltage value to be longer as a number of times of the update is greater.

2. The liquid discharge apparatus according to claim 1, wherein the voltage updater sets the time interval of update of the voltage value to be exponentially longer as the number of times of the update is greater.

3. The liquid discharge apparatus according to claim 1, wherein the voltage updater sets the time interval of update of the voltage value to be longer than a repeated time interval after the repeated time interval is repeated multiple times.

4. The liquid discharge apparatus according to claim 1, wherein the head drive controller includes a correction measurement unit to measure an accumulated time of application time of the drive waveform, and the voltage updater updates the voltage value when the accumulated time reaches the time interval of the update.

5. The liquid discharge apparatus according to claim 4, wherein the correction measurement unit measures, as the accumulated time, an accumulated time of application time of the drive waveform from an update timing to a next update timing.

6. The liquid discharge apparatus according to claim 4, wherein the drive waveform generator generates, as the drive waveform, a waveform that changes relative to an intermediate potential as a reference potential, and wherein the correction measurement unit measures, as the application time, an application time of the intermediate potential.

7. The liquid discharge apparatus according to claim 1, wherein the head drive controller includes a correction measurement unit to measure an integrated accumulated time of application time of the drive waveform, and the voltage updater updates the voltage value when the integrated accumulated time reaches an integration of the time interval of the update.

8. The liquid discharge apparatus according to claim 7, wherein the correction measurement unit measures, as the integrated accumulated time, an integrated time of accumulated time of application time of the drive waveform from a start of use of the liquid discharge apparatus.

9. The liquid discharge apparatus according to claim 1, wherein the electromechanical transducer element is a flexurally-deformable element.

10. The liquid discharge apparatus according to claim 1, further comprising:

a table in which the time interval of the update and an update value of the voltage value of the drive waveform are associated.

11. The liquid discharge apparatus according to claim 1, further comprising:

a plurality of tables in which time intervals of the update and update values of the voltage value of the drive waveform are associated with environmental temperatures.

12. A non-transitory storage medium storing a program for causing a computer to perform processing, the processing comprising:

controlling generation and output of a drive waveform to be applied to the electromechanical transducer element of the actuator of the liquid discharge head according to claim 1;

updating a voltage value of the drive waveform to a larger value with an elapse of time; and setting a time interval of the updating of the voltage value to be longer as a number of times of the updating is greater.

13. The liquid discharge apparatus according to claim 1, wherein the voltage updater is configured to automatically update of the voltage value at longer time intervals as the number of times of the update increases.

14. A head drive control device comprising:

a drive waveform generator to generate a drive waveform to be applied to an electromechanical transducer element of an actuator of a liquid discharge head, to drive and control the liquid discharge head; and a voltage updater to update a voltage value of the drive waveform to a larger value with an elapse of time, the voltage updater to set a time interval of update of the voltage value to be longer as a number of times of the update is greater.

15. An actuator drive control device comprising:

a drive waveform generator to generate a drive waveform to be applied to an electromechanical transducer element of an actuator, to drive and control the actuator; and a voltage updater to update a voltage value of the drive waveform to a larger value with an elapse of time, the voltage updater to set a time interval of update of the voltage value to be longer as a number of times of the update is greater.

* * * * *